US010982864B2

(12) United States Patent
Almaoula

(10) Patent No.: US 10,982,864 B2
(45) Date of Patent: Apr. 20, 2021

(54) CONDENSER COVERING DEVICE

(71) Applicant: Ahmad Almaoula, Worcester, MA (US)

(72) Inventor: Ahmad Almaoula, Worcester, MA (US)

( * ) Notice: Subject to any disclaimer, the term of this patent is extended or adjusted under 35 U.S.C. 154(b) by 333 days.

(21) Appl. No.: 15/978,977

(22) Filed: May 14, 2018

(65) Prior Publication Data

US 2019/0346160 A1 Nov. 14, 2019

(51) Int. Cl.

| | |
|---|---|
| ***F24F 1/58*** | (2011.01) |
| ***E05C 19/16*** | (2006.01) |
| *F24F 13/20* | (2006.01) |

(52) U.S. Cl.

CPC ..... *F24F 1/58* (2013.01); *E05C 19/16* (2013.01); *E05Y 2600/13* (2013.01); *E05Y 2900/60* (2013.01); *F24F 2013/202* (2013.01); *F28F 2265/02* (2013.01); *Y10S 160/16* (2013.01)

(58) Field of Classification Search

CPC ..... F24F 1/56; F24F 1/58; F24F 2013/202; F28F 2265/02; E05C 19/16; E05Y 2600/13; Y10S 160/16

See application file for complete search history.

(56) References Cited

U.S. PATENT DOCUMENTS

| | | | | |
|---|---|---|---|---|
| D224,293 | S | 5/1977 | Carluccio | |
| 4,723,419 | A * | 2/1988 | Kessler | F24F 1/38 165/145 |
| 4,815,530 | A * | 3/1989 | Scott | F24F 13/20 165/134.1 |
| 4,953,328 | A | 9/1990 | Sewell | |
| 5,158,486 | A * | 10/1992 | Tamame | F24F 13/20 160/368.1 |
| 6,397,617 | B1 * | 6/2002 | Johnson | E05C 19/16 49/465 |
| 7,140,194 | B1 | 11/2006 | Miller | |
| 9,435,561 | B2 * | 9/2016 | Bowen | F24F 13/20 |
| 10,670,281 | B2 * | 6/2020 | Jones | F24F 1/56 |
| 2007/0204945 | A1 | 9/2007 | Ross | |
| 2008/0178624 | A1 | 7/2008 | Zedney | |
| 2013/0161215 | A1 | 6/2013 | Dowdy et al. | |
| 2013/0174882 | A1 | 7/2013 | Ellenbecker | |
| 2015/0338125 | A1 * | 11/2015 | Bowen | F24F 1/06 150/165 |
| 2016/0305148 | A1 | 10/2016 | Poston et al. | |
| 2017/0051927 | A1 | 2/2017 | Johnson | |
| 2017/0074526 | A1 | 3/2017 | Colantuoni et al. | |

FOREIGN PATENT DOCUMENTS

CN 206496563 U * 9/2017

OTHER PUBLICATIONS 5 page PDF of machine translation of CN 206496563 U to Yang et al. (Year: 2017).*

* cited by examiner

*Primary Examiner* — Robert Canfield

(57) ABSTRACT

A condenser covering device for an air conditioner condensing unit includes a panel that is shaped and sized complementarily to an upper surface of a condenser unit. A hinge is coupled to and extends between a perimeter of the panel and the condenser unit. A panel magnet is coupled to the panel proximate to the perimeter. The panel magnet is configured to magnetically couple to the upper surface of the condenser unit to couple the panel to the condenser unit to cover the upper surface of the condenser unit.

8 Claims, 3 Drawing Sheets

CONDENSER COVERING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to covering devices and more particularly pertains to a new covering device for an air conditioner condensing unit.

BRIEF SUMMARY OF THE INVENTION

An embodiment of the disclosure meets the needs presented above by generally comprising a panel that is shaped and sized complementarily to an upper surface of a condenser unit. A hinge is coupled to and extends between a perimeter of the panel and the condenser unit. A panel magnet is coupled to the panel proximate to the perimeter. The panel magnet is configured to magnetically couple to the upper surface of the condenser unit to couple the panel to the condenser unit to cover the upper surface of the condenser unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
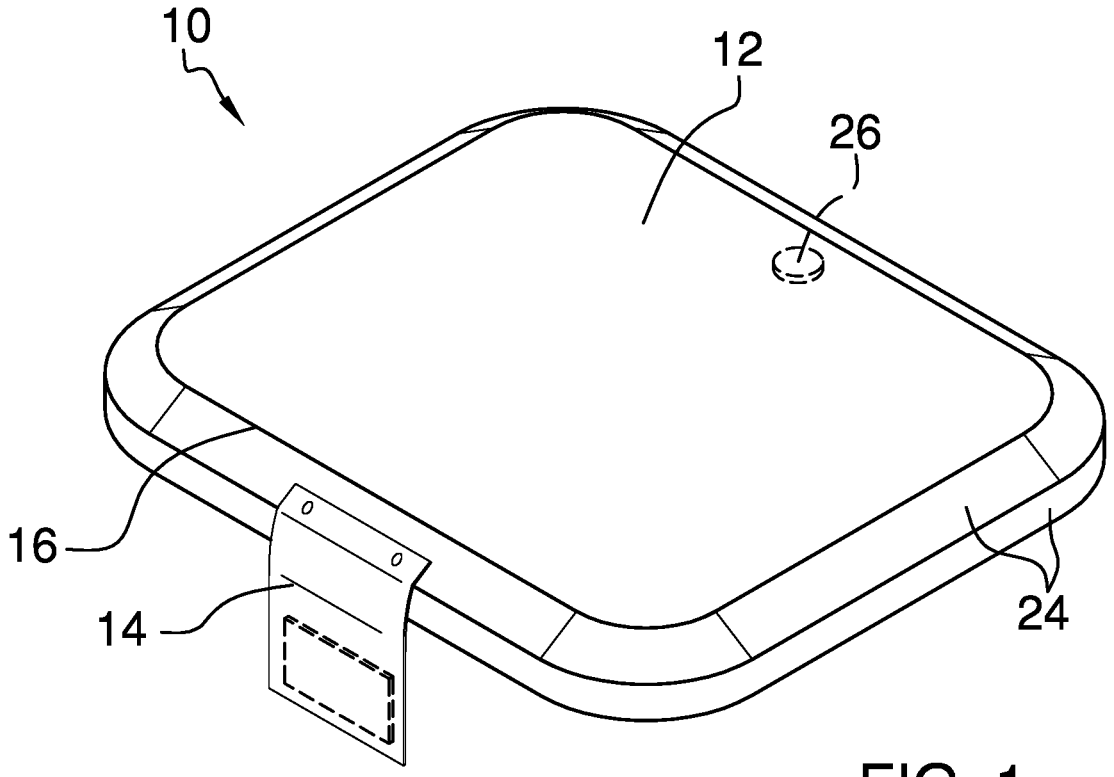
FIG. 1 is an isometric perspective view of a condenser covering device according to an embodiment of the disclosure.

With reference now to the drawings, and in particular to FIGS. 1 through 4 thereof, a new covering device embodying the principles and concepts of an embodiment of the disclosure and generally designated by the reference numeral 10 will be described.

As best illustrated in FIGS. 1 through 4, the condenser covering device 10 generally comprises a panel 12 that is shaped and sized complementarily to an upper surface of a condenser unit. The panel 12 comprises rigid plastic, semi-rigid plastic, or the like. The panel 12 is circularly shaped, rectangularly shaped, squarely shaped, or the like.

Figure 4:
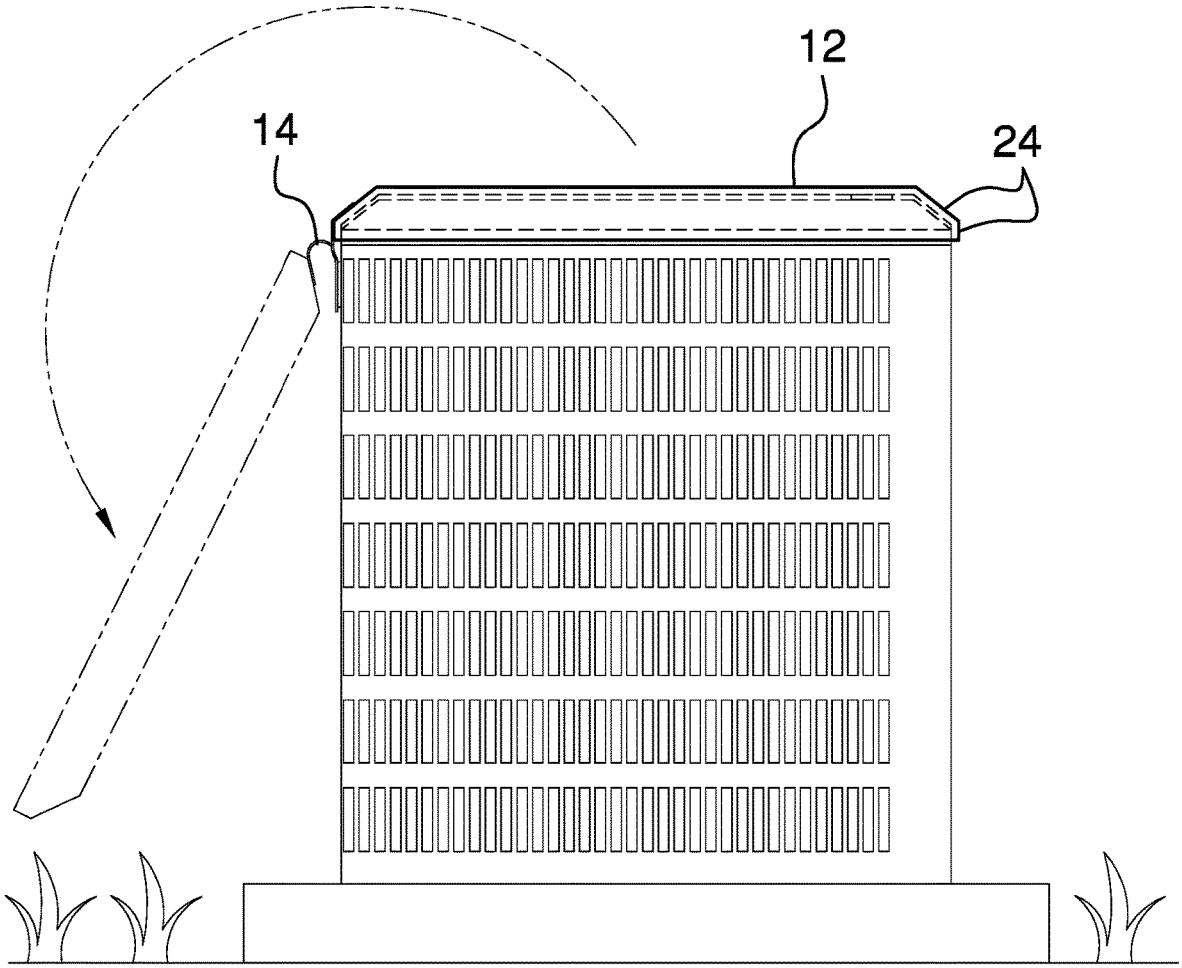
FIG. 4 is an in-use view of an embodiment of the disclosure.

A hinge 14 is coupled to and extends between a perimeter 16 of the panel 12 and the condenser unit, as shown in FIG. 4. The hinge 14 comprises a strap 18 that is coupled to and extends between the panel 12 and the condenser unit. The strap 18 is flexible so that the panel 12 is hingedly coupled to the condenser unit. The panel 12 is configured to pivot relative to the condenser unit when the condenser unit is actuated, as shown in FIG. 4.

Figure 3:
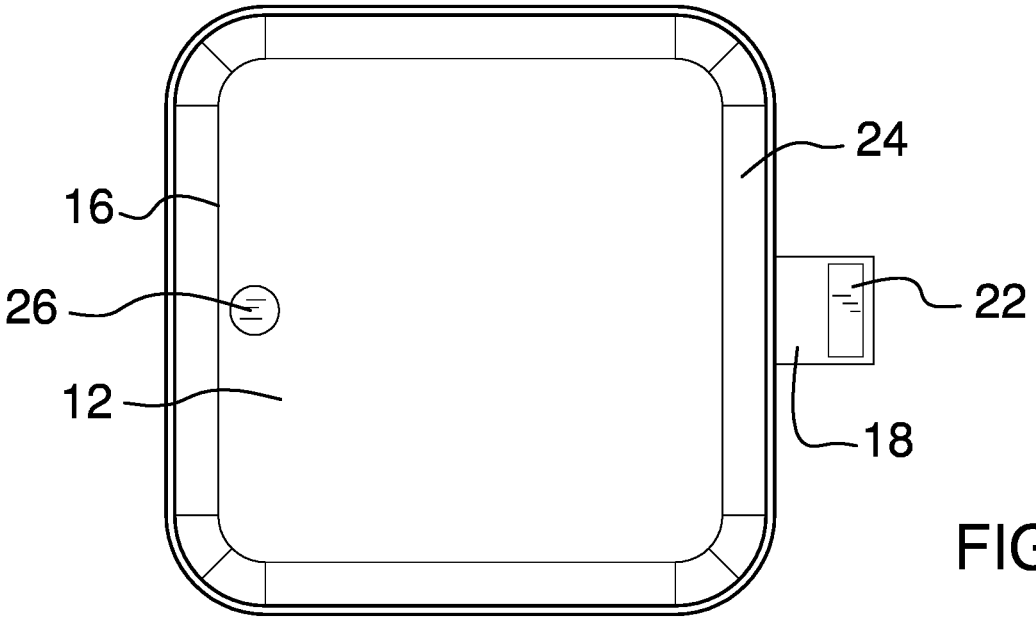
FIG. 3 is a bottom view of an embodiment of the disclosure.

A coupler 20 is coupled to the strap 18 distal from the panel 12, as shown in FIG. 3. The coupler 20 is configured to reversibly couple the strap 18 to the condenser unit. The coupler 20 comprises a strap magnet 22 that is configured to magnetically couple the strap 18 to the condenser unit to hingedly couple the panel 12 to the condenser unit.

Figure 2:
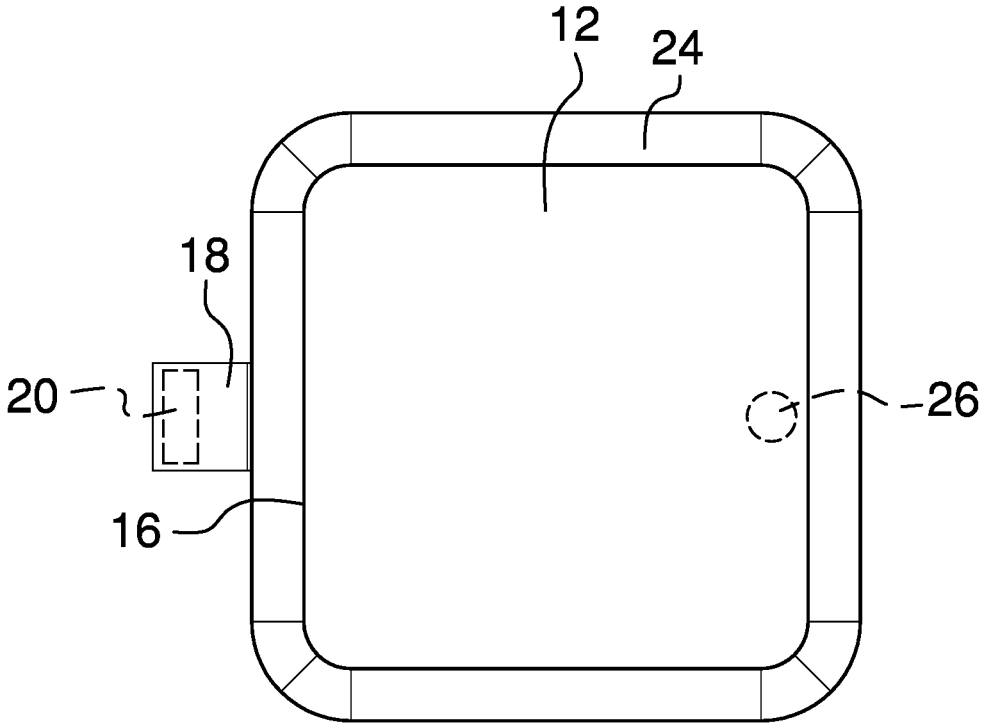
FIG. 2 is a top view of an embodiment of the disclosure.

A lip 24 is coupled to and extends from the perimeter 16 of the panel 12, as shown in FIG. 2. The panel 12 and the lip 24 complement a profile of the upper surface of the condenser unit. The hinge 14 is coupled to and extends from the lip 24.

A panel magnet 26 is coupled to the panel 12 proximate to the perimeter 16, as shown in FIG. 3. The panel magnet 26 is opposingly positioned on the panel 12 relative to the hinge 14. The panel magnet 26 is configured to magnetically couple to the upper surface of the condenser unit to couple the panel 12 to the condenser unit to cover the upper surface of the condenser unit. The panel magnet 26 is weakly magnetic and is configured to decouple from the condenser unit when the condenser unit is actuated, positioning the panel 12 to pivot relative to the condenser unit, as shown in FIG. 4.

In use, the strap magnet 22 is configured to magnetically couple the strap 18 to the condenser unit to hingedly couple the panel 12 to the condenser unit. The panel magnet 26 is configured to magnetically couple to the upper surface of the condenser unit to couple the panel 12 to the condenser unit to cover the upper surface of the condenser unit. The panel magnet 26 is configured to decouple from the condenser unit when the condenser unit is actuated, positioning the panel 12 to pivot relative to the condenser unit.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A condenser covering device comprising:

a panel shaped and sized complementarily to an upper surface of a condenser unit;

a hinge coupled to and extending between a perimeter of said panel and the condenser unit, said hinge comprising a strap coupled to and extending between said panel and the condenser unit, said strap being flexible such that said panel is hingedly coupled to the condenser unit wherein said panel is configured for pivoting relative to the condenser unit when the condenser unit is actuated;

a coupler coupled to said strap distal from said panel wherein said coupler is configured for reversibly coupling said strap to the condenser unit, the coupler being a strap magnet wherein said strap magnet is configured for magnetically coupling said strap to the condenser unit for hingedly coupling said panel to the condenser unit;

a panel magnet coupled to said panel proximate to said perimeter wherein said panel magnet is configured for magnetically coupling to the upper surface of the condenser unit for coupling said panel to the condenser unit for covering the upper surface of the condenser unit; and a lip coupled to and extending from said perimeter of said panel such that said panel and said lip complement a profile of the upper surface of the condenser unit.

2. The device of claim 1, further including said panel comprising plastic.

3. The device of claim 1, further including said panel being rectangularly shaped.

4. The device of claim 3, further including said panel being squarely shaped.

5. The device of claim 1, further including said hinge being coupled to and extending from said lip.

6. The device of claim 1, further including said panel magnet being magnetic such that said panel magnet is configured for decoupling from the condenser unit when the condenser unit is actuated positioning said panel for pivoting relative to the condenser unit.

7. The device of claim 1, further including said panel magnet being opposingly positioned on said panel relative to said hinge.

8. A condenser covering device comprising:

a panel shaped and sized complementarily to an upper surface of a condenser unit, said panel comprising plastic, said panel being squarely shaped;

a hinge coupled to and extending between a perimeter of said panel and the condenser unit, said hinge comprising a strap coupled to and extending between said panel and the condenser unit, said strap being flexible such that said panel is hingedly coupled to the condenser unit wherein said panel is configured for pivoting relative to the condenser unit when the condenser unit is actuated;

a coupler coupled to said strap distal from said panel wherein said coupler is configured for reversibly coupling said strap to the condenser unit, said coupler comprising a strap magnet wherein said strap magnet is configured for magnetically coupling said strap to the condenser unit for hingedly coupling said panel to the condenser unit;

a lip coupled to and extending from said perimeter of said panel such that said panel and said lip complement a profile of the upper surface of the condenser unit, said hinge being coupled to and extending from said lip;

a panel magnet coupled to said panel proximate to said perimeter wherein said panel magnet is configured for magnetically coupling to the upper surface of the condenser unit for coupling said panel to the condenser unit for covering the upper surface of the condenser unit, said panel magnet being opposingly positioned on said panel relative to said hinge, said panel magnet being magnetic such that said panel magnet is configured for decoupling from the condenser unit when the condenser unit is actuated positioning said panel for pivoting relative to the condenser unit; and wherein said strap magnet is configured for magnetically coupling said strap to the condenser unit for hingedly coupling said panel to the condenser unit, wherein said panel magnet is configured for magnetically coupling to the upper surface of the condenser unit for coupling said panel to the condenser unit for covering the upper surface of the condenser unit, wherein said panel magnet is configured for decoupling from the condenser unit when the condenser unit is actuated positioning said panel for pivoting relative to the condenser unit.

* * * * *